US005122053A

United States Patent [19]

Basten

[11] Patent Number: 5,122,053

[45] Date of Patent: Jun. 16, 1992

[54] APPARATUS AND METHOD FOR THE COMBUSTION OF LIQUID OR GASEOUS FUELS

[76] Inventor: Gert Basten, Rebhaldenweg 39, CH-7206 Igis, Switzerland

[21] Appl. No.: 438,857

[22] Filed: Nov. 17, 1989

[30] Foreign Application Priority Data

Nov. 17, 1988 [CH] Switzerland ..... 04266/88

[51] Int. Cl.[5] ..... F23N 1/02

[52] U.S. Cl. ..... 431/12; 431/90; 236/15 BD

[58] Field of Search ..... 431/90, 1, 12; 236/15 BD

[56] References Cited

U.S. PATENT DOCUMENTS 3,796,536 3/1974 Hori et al. ..... 431/183
3,905,752 9/1975 Miller ..... 431/183
4,605,167 8/1986 Maehara ..... 431/1 X
4,887,958 12/1989 Hagar ..... 431/12

FOREIGN PATENT DOCUMENTS 2041081 9/1980 United Kingdom ..... 431/1

*Primary Examiner*—William E. Wayner
*Attorney, Agent, or Firm*—Watts, Hoffmann, Fisher & Heinke

[57] ABSTRACT

With the constantly varying atmospheric conditions, in order nevertheless to achieve constantly a perfect, near stoichiometric combustion with extremely low power consumption and virtually without noise, one supplies solely the instantaneous quantity of air, which is absolutely necessary for combustion, depending on the quantity of fuel supplied, regulated in an exactly metered manner, to the atomization region of an ultrasound fuel atomizer. The air supplied in this way is mixed in the fuel outlet region of the fuel atomizer with the fuel atomized in this way and this mixture is burnt in an adjoining combustion chamber.

3 Claims, 3 Drawing Sheets

APPARATUS AND METHOD FOR THE COMBUSTION OF LIQUID OR GASEOUS FUELS

BACKGROUND OF THE INVENTION

1. Field of the Invention

The invention relates to a method for the atomization at low pressure and near stoichiometric combustion of liquid or gaseous fuels, a device for carrying out this method, a heating installation with such a device as well as an air-conditioning system with such a heating installation.

2. Description of the Related Art

It is known to atomize liquid fuels using a high fuel pressure and an atomizer nozzle or with the assistance of additional compressed air and to mix the fuel atomized in this way by means of a powerful air compressor to produce an ignitable mixture of fuel and air.

However, these known burners have the drawbacks that their operation necessitates a relatively high drive power, that they are relatively noisy in operation and complicated as regards construction and maintenance and that they operate in an optimum manner solely at a single, quite specific atmospheric condition, to which they were once adjusted, which, however, is naturally only seldom the case, since the important atmospheric parameters for optimum combustion, such as air pressure, temperature, chimney draft, blowing-in direction and intensity at the chimney outlet opening etc. naturally vary continuously. Furthermore, the smallest quantity of fuel which can still be burnt in a trouble-free manner per unit time is still too high for many applications.

SUMMARY OF THE INVENTION

It is therefore in particular the object of the present invention to provide a method and a device for carrying out this method, which do not have these above-mentioned drawbacks and for all continuously varying atmospheric conditions facilitate complete combustion, i.e., near stoichiometric combustion and can burn even very small quantities of fuel per unit time, still in a satisfactory manner.

This object is achieved according to the invention by means of a method wherein solely the instantaneous quantity of air required for this combustion, regulated in an exactly metered manner depending on the quantity of fuel supplied, is supplied to the atomization region of an ultrasound fuel atomizer, is mixed in the fuel outlet region of the latter with the fuel atomized in this way and this mixture is burnt in an adjoining combustion chamber.

In this case it is appropriate if a swirl is imparted to the air supplied to the atomization region of the fuel atomizer, before mixing with the atomized fuel so that the swirl axis coincides at least approximately with the main direction of atomization of the fuel atomizer.

Furthermore, the invention relates to a device for carrying out the method comprising a speed-regulated airstream generator for generating the volumetric airstream respectively required for the near stoichiometric combustion, a first flow-guiding apparatus located downstream of this airstream generator in the direction of flow, for producing an at least approximately laminar airstream, a volumetric airstream measuring device located in this laminar flow region, a second flow-guiding apparatus, located after this laminar flow region in the through-flow direction, for mixing the combustion air supplied in a metered manner, with atomized fuel supplied from an ultrasound fuel atomizer and a calculating unit connected to the volumetric airstream measuring device for regulating the speed and/or direction of rotation of the airstream generator depending on the quantity of fuel supplied to the fuel atomizer.

The invention also relates to a heating installation with the above mentioned and an air-conditioning system.

BRIEF DESCRIPTION OF THE DRAWINGS

The invention will be described hereafter by way of example with reference to the drawings, in which.

DETAILED DESCRIPTION OF THE DRAWINGS

Figure 1:
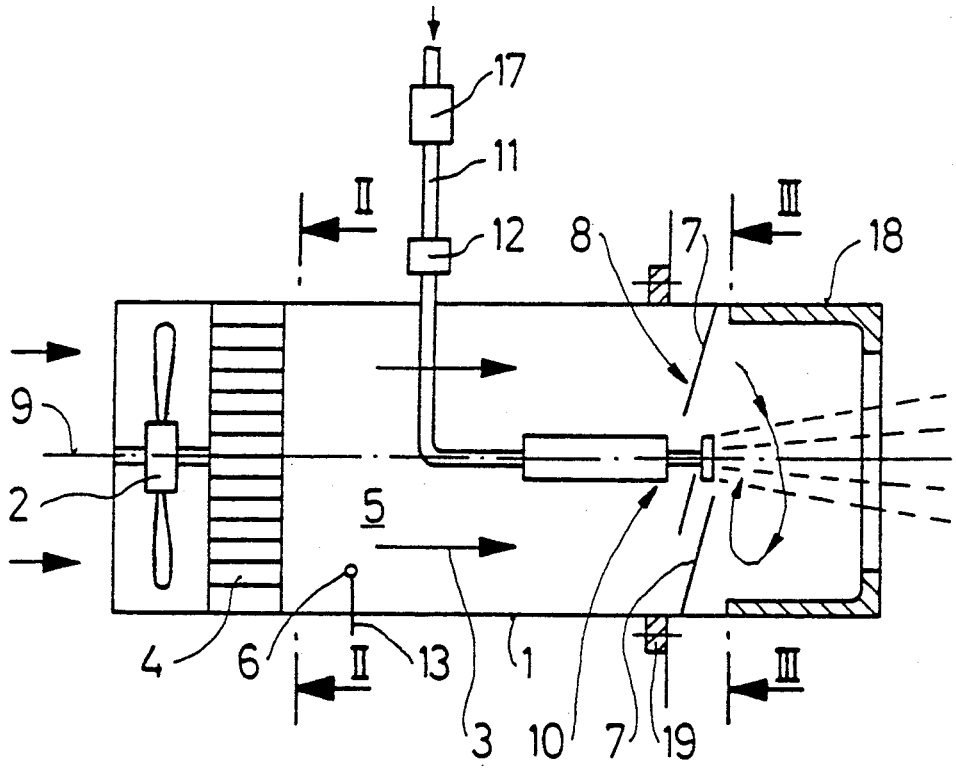
FIG. 1 is a longitudinal section through one embodiment of a device according to the invention.
Figure 2:
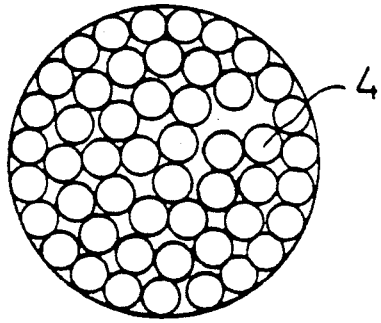
FIG. 2 is a section on line II—II of FIG. 1.
Figure 3:
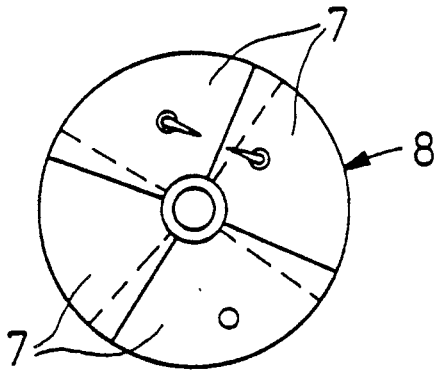
FIG. 3 is a section on line III—III of FIG. 1.

As shown in FIGS. 1 to 3, the device illustrated comprises within the cylindrical housing 1, a speed-regulated airstream generator 2 of for example 1.8 watts for producing an airstream 3, as well as a first flow-guiding apparatus 4 located downstream of this airstream generator 2 in the flow direction, for producing an at least approximately laminar airstream.

A virtually laminar airstream is necessary for the exact measurement of the air volume flowing through.

Located in this laminar flow region 5 is a commercially available volumetric airstream measuring device 6 and in the through-flow region after this laminar flow region 5, a second flow-guiding apparatus 8 consisting of five guide vanes 7 (see in particular FIG. 3). This guiding apparatus 8 imparts to the air flowing through and regulated exactly as regards quantity, a swirl about the longitudinal axis 9 of the burner for intensive mixing of the air supplied in a metered manner with extremely finely atomized heating oil supplied from the ultrasound fuel atomizer 10. The heating oil is supplied by means of a pump (not shown) by way of the pipe 11 and the solenoid valve 12 a low pressure to the fuel atomizer 10 provided with a piezoelectric ultrasound oscillator.

Figure 4:
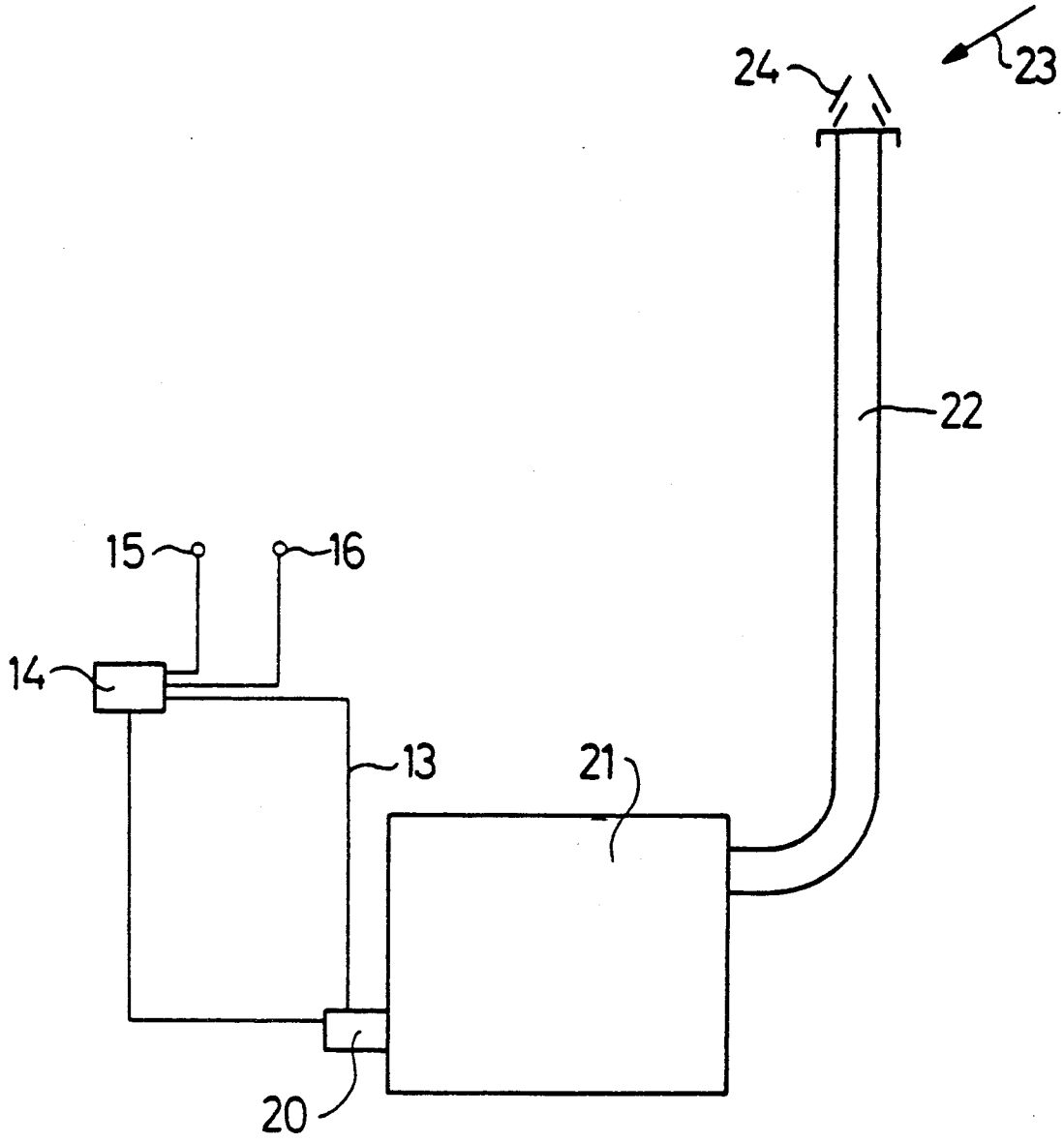
FIG. 4 shows diagrammatically one embodiment of a heating installation according to the invention.

As shown in FIG. 4, a calculating unit 14 connected to the volumetric airstream measuring device 6 by way of an electrical connector 13. The calculating unit 14 is connected to an atmosphere air temperature sensor 15, an atmosphere air pressure sensor 16 as well as a fuel throughflow measuring device 17 via line 13 and from the parameters ascertained in this way immediately calculates electronically the exact quantity of air necessary for near stoichiometric combustion, and, if necessary, regulates the speed of the airstream generator 2 via line 2*a* until the necessary quantity of air is supplied exactly.

Naturally it would also be possible to allow the airstream generator 2 to rotate constantly and to regulate the quantity of fuel to be supplied according to the parameters ascertained in this way.

Located in the flow direction after the fuel atomizer 10 is a fire tube 18 of ceramic material. The adjoining combustion chamber can be lined in known manner with firebrick.

In order to protect the apparatus part of the burner from excessive heat, the fire tube 18 is connected to the remaining part of the burner by way of a thermal insulation 19.

As shown in FIG. 4, the aforementioned burner is connected to a boiler 21 and the latter is connected at the exhaust-gas side to a chimney 22.

In order to avoid undesirable pressure fluctuations in the chimney 22, the outlet of the latter is provided with a chimney cowl 24 in order to ensure that the chimney draft is influenced as little as possible by the outwardly flowing airstream 23. A chimney attachment of this type can be obtained for example under the trade name "BASTEN-REGULATOR" (Registered Trade Mark) from the company Inventina AG, CH-7302 Landquart (Switzerland).

A chimney cowl of this type minimizes the influence of various oncoming flows of wind of the chimney outlet opening on the natural draft in the chimney 22, so that even in the case of very gusty winds, the air pressure in the boiler 21 remains virtually unaffected by such chimney inflows and therefore represents an extremely important component in this burner concept.

The aforementioned burner can itself be used for the combustion of less than 300 grams of heating oil per hour and produces virtually no noise.

The ignition device and the control of the piezoelectric ultrasound oscillator are commercially available and therefore are not described in detail. For a single family house, the entire electrical power consumption of this burner including the measuring and regulating device does not exceed an amount of 10 to 15 watts.

If a two-component boiler 21' (FIG. 5) is used, then a CO (carbon monoxide) as well as a $CO_2$ (carbon dioxide) sensor 25 respectively 26 is located at the exhaust-gas side, for example at the outlet of this boiler, for the near stoichiometric combustion of solid fuels.

These sensors 25 and 26 are connected electrically to the calculating unit 14, the latter being programmed so that when burning solid fuels in the boiler combustion chamber, depending on the CO and $CO_2$ actual values ascertained in this way at the exhaust-gas side and given corresponding reference values, the speed and/or direction of rotation of the airstream generator 2 is regulated to achieve near stoichiometric combustion with low excess air.

Figure 5:
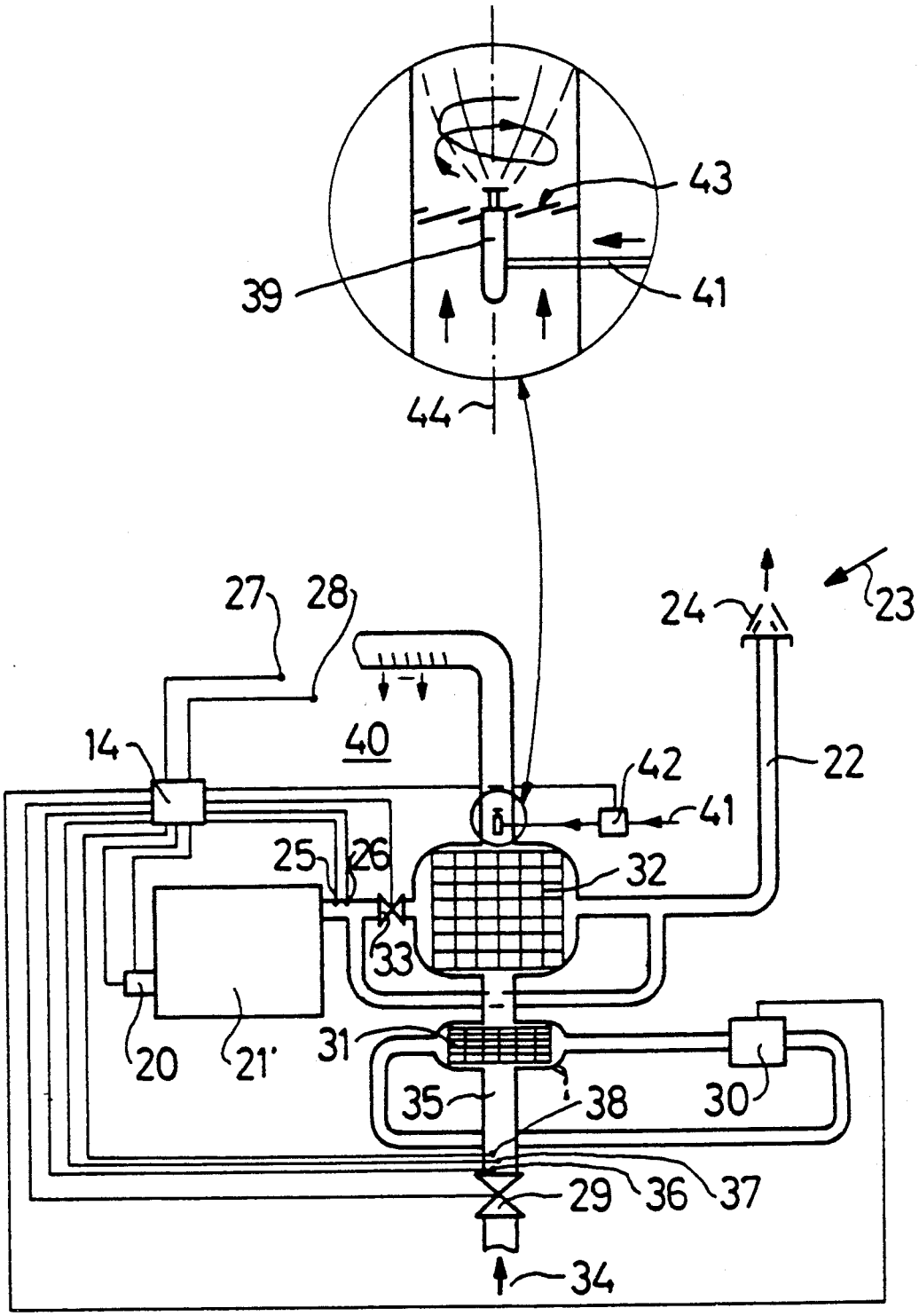
FIG. 5 shows diagrammatically one embodiment of an air-conditioning system according to the invention.

FIG. 5 also illustrates an air-conditioning system provided with a heating installation according to the invention, for the air conditioning of housing space or office space.

Depending on the actual values of the climate in the room ascertained in this case by means of the sensors 27 and 28 (such as oxygen content, temperature and moisture content of the air in the room) and the given reference values, the intake air to be prepared is sent by way of a regulating member 29 appropriately controlled as regards volume by the calculating unit 14, first of all to a first heat exchanger 31 connected to the cooling installation 30 and then to a second heat exchanger 32 connected to the heating installation 21', the cooling installation 30 and the regulating member 33 regulating the supply of heat to the second heat exchanger 32 likewise being controlled depending on the actual values of the climate of the room ascertained and the given reference values, by the calculating unit 14.

The first heat exchanger 31 can be used for cooling the intake air 34 supplied or in combination with the second heat exchanger 32 for dehumidifying same.

For this purpose, the calculating unit 14 is connected to a volumetric airstream measuring device 36 located in the intake air duct 35 and to a temperature and moisture sensor 37 and 38 for ascertaining the corresponding actual values of the intake air 34.

Also located in the intake air duct 35 is a water-ultrasound atomizer 39, which depending on actual values of moisture ascertained in the air duct and/or in the room 40 to be air-conditioned and supplied to the calculating unit 14, and given reference values, increases the moisture content of the air flowing through, if the moisture content falls below the reference value. Also located in the water supply pipe 41 of the atomizer 39 is a solenoid valve 42 likewise controlled by the calculating unit 14, in order to regulate the inflow of water to the atomizer 39.

A water atomizer 39 provided with a piezoelectric ultrasound transmitter is therefore extremely advantageous, since with an atomizer of this type, it is possible to introduce the necessary liquid to be supplied, in the form of an extremely fine mist, into the through-flowing air 34.

In order to introduce this liquid mist in a trouble-free manner into the through-flowing intake air 34, there is provided in the outlet region of the ultrasound atomizer 39, a flow-guiding apparatus 43 consisting of guide vanes, which imparts to the intake air 34 supplied in a metered manner and to be enriched with water, in this mixing region, a considerable swirl about the longitudinal axis of flow 44.

In this way, the air-conditioning system illustrated is used for the purpose of correction, not continuously as hitherto, but solely when the actual values deviate too much from the reference values for the climate in the room, which allows a considerable saving of energy and an inadequate exchange of air involving the various drawbacks and risks as well as excessively high ventilation with correspondingly high heating costs can be avoided.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. A method of atomization of liquid or gaseous fuels for near-stoichiometric combustion in a combustion chamber comprising the steps of:

sensing the pressure of the atmospheric air;

sensing the temperature of said air;

supplying said air along an in the path leading to the combustion chamber;

guiding the flow of said air in the intake path to achieve a substantially laminar flow region;

instantaneously measuring the quantity of said air in the laminar flow region;

supplying fuel at low pressure to said combustion chamber;

instantaneously measuring the quantity of fuel being supplied;

guiding the flow of air in the intake path to cause a swirl about the approximate center axis of the path;

atomizing the fuel about said approximate center axis with a piezoelectric ultrasound atomizer into the swirling air;

instantaneously regulating the quantity of air supplied to the combustion chamber as a function of the sensed atmospheric air temperature and pressure and the measured quantities of air and fuel to achieve near-stoichiometric combustion; and covering the chimney outlet with a cowling means to substantially eliminate air pressure variations in the combustion chamber due to atmospheric wind.

2. A device for the atomization and near-stoichiometric combustion of liquid or gaseous fuels comprising:

a combustion chamber;

an air intake channel connected to said combustion chamber;

a sensor for measuring the pressure of the atmospheric air;

a sensor for measuring the temperature of said air;

a low pressure supply of fuel;

a piezoelectric ultrasound atomizer for atomizing said fuel, said atomizer having an outlet disposed near the approximate center axis of said intake channel;

means for instantaneously measuring the quantity of said fuel supplied;

a speed-regulated airstream generator for generating a stream of said air;

a first flow-guiding means located downstream of the airstream generator for producing a substantially laminar air flow;

a volumetric airstream measuring device located in the substantially laminar air flow;

a second flow-guiding means for imparting a swirl to the airstream about said center axis, wherein the second flow-guiding means is located downstream of the first flow-guiding means and upstream of the atomizer; and a calculating unit connected to the pressure sensor, the temperature sensor, the volumetric airstream measuring means and the fuel measuring means for instantaneously regulating the airstream generator as a function of atmospheric air temperature and pressure and the quantity of fuel supplied to the atomizer to achieve near-stoichiometric combustion; and wherein the device forms part of a heating installation having an exhaust gas chimney and wherein the chimney outlet has a cowling for substantially eliminating pressure variations in the combustion chamber due to atmospheric wind.

3. A device according to claim 3 wherein the fuel atomizer outlet is surrounded by a ceramic tube.

* * * * *